US009107505B1

(12) United States Patent
Ma

(10) Patent No.: US 9,107,505 B1
(45) Date of Patent: Aug. 18, 2015

(54) SEAT PAD

(71) Applicant: Ju-Yi Ma, Nantou (TW)

(72) Inventor: Ju-Yi Ma, Nantou (TW)

( * ) Notice: Subject to any disclaimer, the term of this patent is extended or adjusted under 35 U.S.C. 154(b) by 0 days.

(21) Appl. No.: 14/178,210

(22) Filed: Feb. 11, 2014

(51) Int. Cl.

| | |
|---|---|
| ***A47C 3/02*** | (2006.01) |
| ***A47C 7/14*** | (2006.01) |
| ***A47C 7/18*** | (2006.01) |
| ***A47C 3/025*** | (2006.01) |

(52) U.S. Cl.
CPC . *A47C 7/14* (2013.01); *A47C 3/025* (2013.01); *A47C 3/0252* (2013.01); *A47C 7/18* (2013.01)

(58) Field of Classification Search
CPC ..... A47C 3/0252
USPC ..... 297/314
See application file for complete search history.

(56) References Cited

U.S. PATENT DOCUMENTS

| | | | | |
|---|---|---|---|---|
| 584,637 | A * | 6/1897 | Jarvis | 297/202 |
| 3,309,137 | A * | 3/1967 | Wiebe | 297/303.1 |
| 3,813,069 | A * | 5/1974 | Fletcher | 248/188.1 |
| 4,871,208 | A * | 10/1989 | Hodgdon | 297/303.1 |
| 5,044,587 | A * | 9/1991 | Degen | 248/158 |
| 5,649,740 | A * | 7/1997 | Hodgdon | 297/303.1 |
| 5,769,492 | A * | 6/1998 | Jensen | 297/314 |
| 6,685,268 | B2 * | 2/2004 | Meyer | 297/313 |
| 2003/0032533 | A1 * | 2/2003 | Hecox et al. | 482/127 |
| 2007/0241599 | A1 * | 10/2007 | Hodgdon | 297/313 |

* cited by examiner

*Primary Examiner* — Peter Brown

(57) ABSTRACT

A seat pad is provided. The seat pad includes a base plate, a middle plate, a foam layer, a cushion member, a fixation plate and a fixation screw. The fixation plate is disposed correspondingly above a middle region of the middle plate, the middle plate is disposed on the cushion member, the cushion member is disposed on the base plate, the fixation screw is disposed through a through hole of the base plate at a middle region of the base plate and screwed with the fixation plate, and the foam layer is attached on the middle plate. Whereby, the seat pad is simple in structure and easy to assemble and can obviate pressure of one's hips, and one's blood circulation will not be hindered and uncomfortableness due to sitting for a long time can be obviated.

1 Claim, 3 Drawing Sheets

SEAT PAD

BACKGROUND OF THE INVENTION

1. Field of the Invention

The present invention relates to a furniture appliance, and particularly to a seat pad swayable according to various sitting postures.

2. Description of the Prior Art

A conventional seat pad is always made in fixed type. The seat pad is correspondingly fixedly attached to a chair, so as to bear the weight of a sitter or articles. However, the sitter will not always maintain a sitting posture. Especially, a sitter who will sit for a long time will, with no doubt, change the sitting posture frequently, so that the center of gravity of the sitter changes accordingly. As a result, seat pad will counteract with various pressures in different directions and levels, and the counteracted pressure from the seat pad will apply to the sitter. As the sitter is seated in an improper sitting posture for a long time, the counteracted pressure can cause bad blood circulation, dullness or numbness et al. which is harmful to healthy.

The present invention is, therefore, arisen to obviate or at least mitigate the above mentioned disadvantages.

SUMMARY OF THE INVENTION

An object of the present invention is to provide a seat pad which is swayable according to various sitting postures so that one's blood circulation will not be hindered and uncomfortableness due to sitting for a long time can be obviated.

To achieve the above and other objects, a seat pad includes a base plate, a middle plate, a foam layer, a cushion member, a fixation plate and a fixation screw. The fixation plate is disposed correspondingly above a middle region of the middle plate, the middle plate is disposed on the cushion member, the cushion member is disposed on the base plate, the fixation screw is disposed through a through hole of the base plate at a middle region of the base plate and screwed with the fixation plate, and the foam layer is attached on the middle plate.

Whereby, the seat pad is simple in structure and easy to assemble and can obviate pressure of one's hips, and one's blood circulation will not be hindered and uncomfortableness due to sitting for a long time can be obviated.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
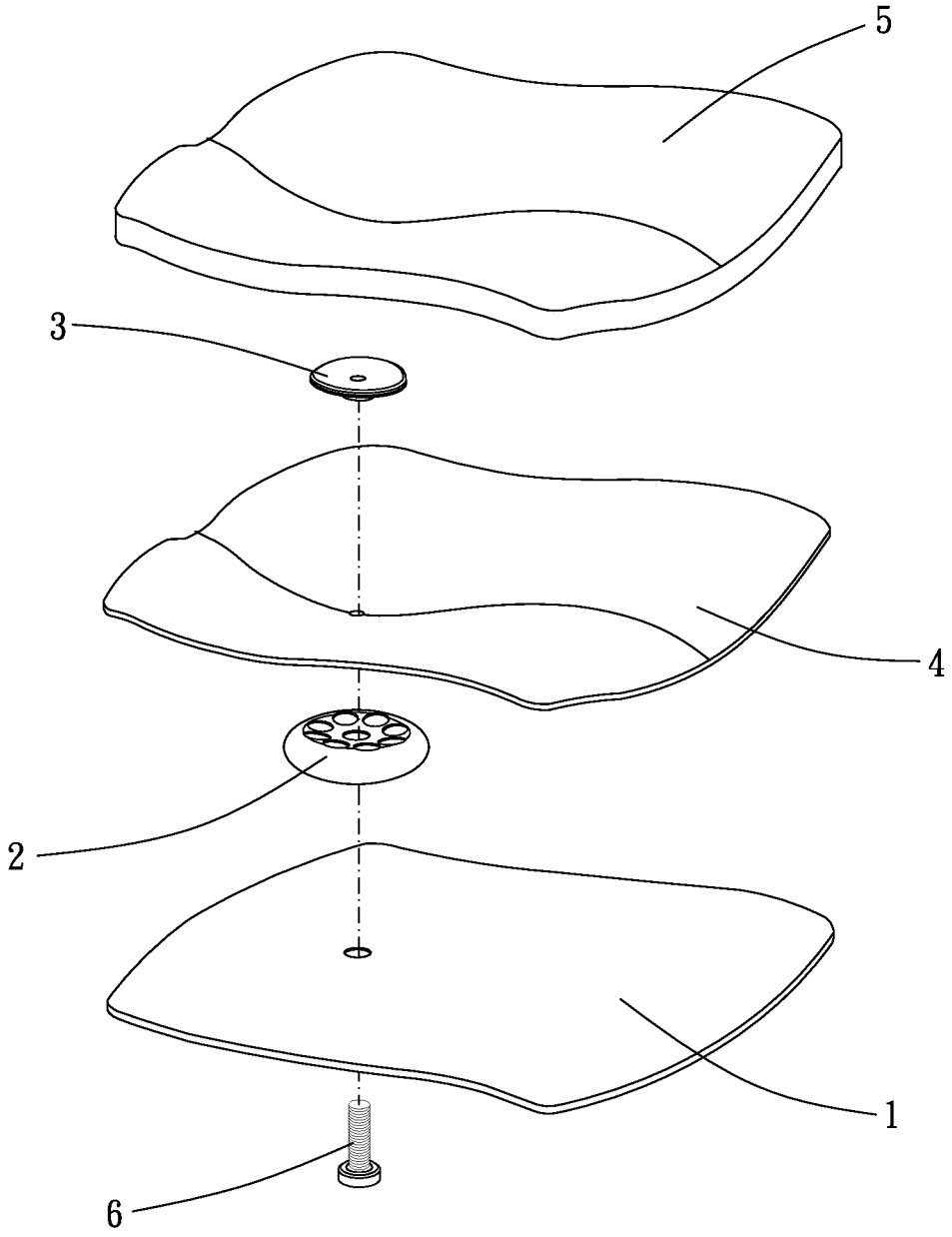
FIG. 1 is a breakdown drawing of a seat pad according to a preferred embodiment of the present invention.
Figure 2:
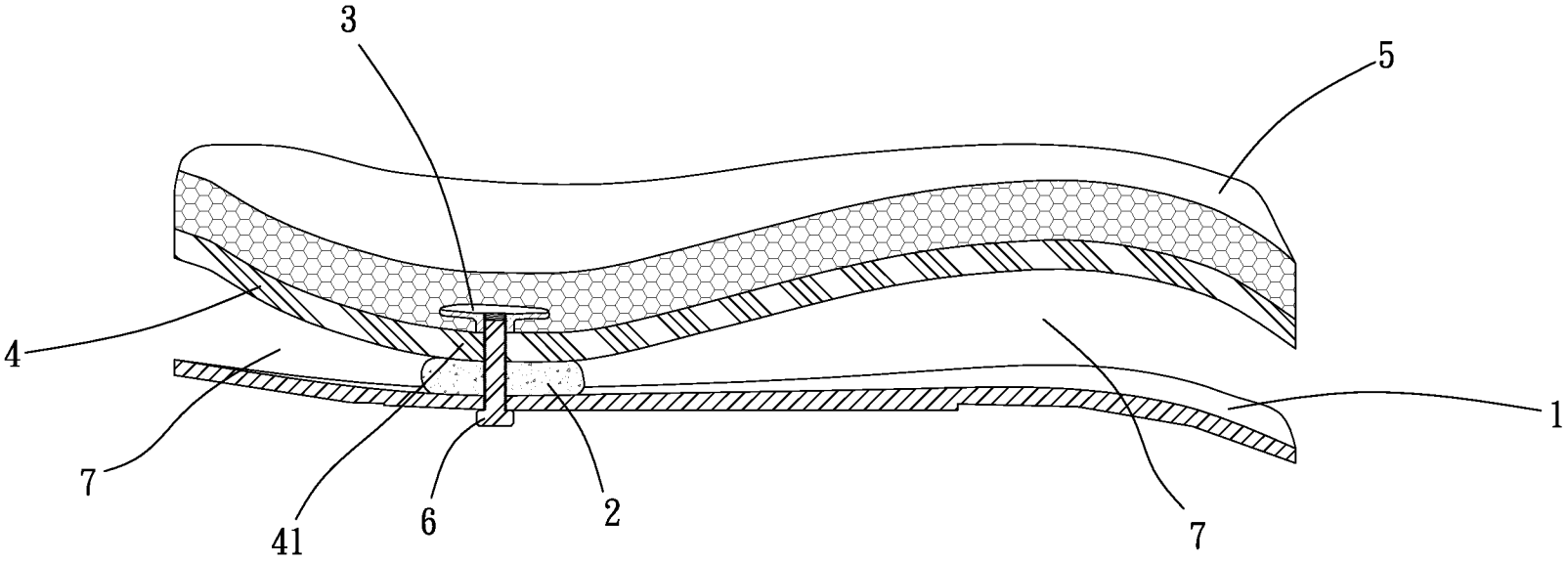
FIG. 2 is a cross-sectional view of a seat pad according to a preferred embodiment of the present invention.
Figure 3:
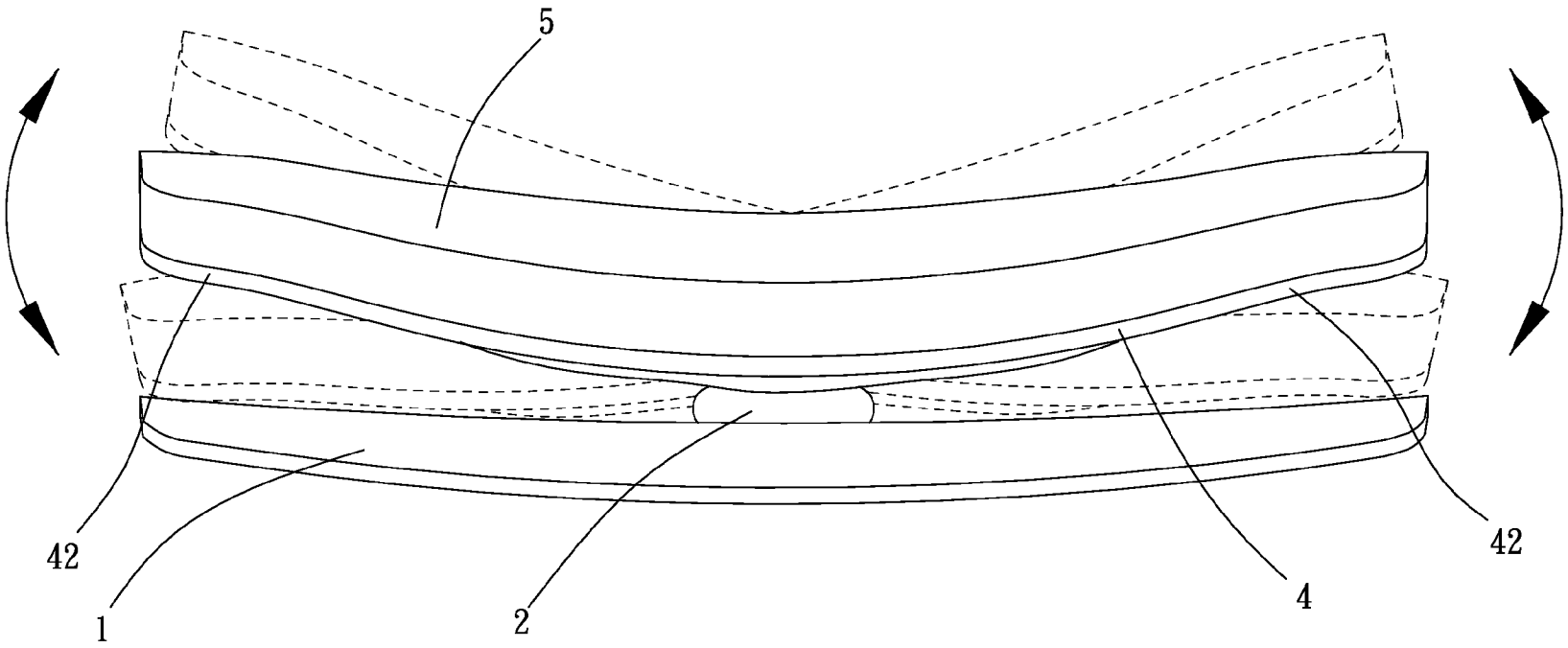
FIG. 3 is a view showing a seat pad in use according to a preferred embodiment of the present invention.

As shown in FIGS. 1 to 3, a seat pad according to a preferred embodiment of the present invention is provided. The seat pad includes a base plate 1, a cushion member 2, a fixation plate 3, a middle plate 4, a foam layer 5 and a fixation screw 6.

The fixation plate 3 is disposed correspondingly above a middle region of the middle plate 4. The middle plate 4 is disposed on the cushion member 2. The middle plate 4 is preferably made of a composite material including nylon or other plastic material which has characteristic of resilience. The cushion member 2 is disposed on the base plate 1. The cushion member 2 is preferably made of rubber or the like which can provide deformation and sway ability of the seat pad so as to avoid stress concentration due to displacement of element(s). The fixation screw 6 is disposed through a through hole of the base plate 1 at a middle region of the base plate 1 and screwed with the fixation plate 3. The foam layer 5 is attached on the middle plate 4.

The middle plate 4 and the foam layer 5 are each wave-shaped and laminated substantially in parallel to be a wave-shaped construction, and peripheral contours of the middle plate 4 and the foam layer 5 correspond to each other. The middle plate 4 has a bottom portion 41 convex toward the base plate 1, the cushion member 2 is sandwiched between the bottom portion 41 of the middle plate 4 and the base plate 1, a surrounding space 7 around the cushion member 2 is formed between the middle plate 4 and the base plate 1, and each extent of the surrounding space 7 which is measured laterally from the peripheral contour of the base plate 1 to the cushion member 2 is greater a lateral dimension of the cushion member 2. The fixation plate 3 is entirely encompassed by the middle plate 4 and the foam layer 5 and embedded in the foam layer 5. When the middle plate 4 and the foam layer 5 sway relative to the base plate 1, an edge portion 42 of a bottom of the middle plate 4 is abuttable against the base plate 1.

When a sitter is seated on the seat pad which is swayable, the center of gravity of the sitter will change according to various sitting postures. As the center of gravity moves forward, the front end of the seat pad sways downward; as the center of gravity moves rearward, the rear end of the seat pad sways downward; as the center of gravity moves rightward, the right end of the seat pad sways downward; as the center of gravity moves leftward, the left end of the seat pad sways downward.

Given the above, the seat pad is simple in structure and easy to assemble. Furthermore, the seat pad is swayable according to various sitting postures which can obviate pressure of one's hips, such that one's blood circulation will not be hindered and uncomfortableness due to sitting for a long time can be obviated.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A seat pad, consisting of a base plate, a middle plate, a foam layer, a cushion member, a fixation plate and a fixation screw, wherein the fixation plate is disposed correspondingly above a middle region of the middle plate, the middle plate is disposed on the cushion member, the cushion member is disposed on the base plate, the fixation screw is disposed through a through hole of the base plate at a middle region of the base plate and screwed to the fixation plate, and the foam layer is attached on the middle plate;

wherein the middle plate and the foam layer are each wave-shaped and laminated substantially in parallel to be a wave-shaped construction, and peripheral contours of the middle plate and the foam layer correspond to each other;

wherein the middle plate has a bottom portion convex toward the base plate, the cushion member is sandwiched between the bottom portion of the middle plate and the base plate, a surrounding space around the cushion member is formed between the middle plate and the base plate, and each extent of the surrounding space which is measured laterally from the peripheral contour of the base plate to the cushion member is greater than a lateral dimension of the cushion member;

wherein the fixation plate is entirely encompassed by the middle plate and the foam layer and embedded in the foam layer;

wherein when the middle plate and the foam layer sway relative to the base plate, an edge of a bottom of the middle plate is abuttable against the base plate.

* * * * *